US008910939B2

(12) United States Patent
Nakura et al.

(10) Patent No.: US 8,910,939 B2
(45) Date of Patent: Dec. 16, 2014

(54) SHEET CARRYING DEVICE AND IMAGE FORMING APPARATUS

(71) Applicants: Makoto Nakura, Ibaraki (JP); Naoto Ueda, Ibaraki (JP); Koichi Kudo, Kanagawa (JP); Shingo Takai, Ibaraki (JP)

(72) Inventors: Makoto Nakura, Ibaraki (JP); Naoto Ueda, Ibaraki (JP); Koichi Kudo, Kanagawa (JP); Shingo Takai, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/780,030

(22) Filed: Feb. 28, 2013

(65) Prior Publication Data

US 2013/0228969 A1 Sep. 5, 2013

(30) Foreign Application Priority Data

Mar. 5, 2012 (JP) ..... 2012-047793
Jul. 20, 2012 (JP) ..... 2012-161381

(51) Int. Cl.
*B65H 5/02* (2006.01)
*B41J 13/00* (2006.01)
*G03G 15/00* (2006.01)

(52) U.S. Cl.
CPC ..... *B41J 13/0009* (2013.01); *G03G 15/6561* (2013.01); *G03G 15/6529* (2013.01)
USPC ..... 271/272

(58) Field of Classification Search
CPC .. B65H 5/062; B65H 2513/108; B65H 9/006; G03G 15/6558
USPC ..... 271/264, 265.01, 272, 242; 399/68, 396
See application file for complete search history.

(56) References Cited

U.S. PATENT DOCUMENTS

| | | | | |
|---|---|---|---|---|
| 5,963,769 | A | 10/1999 | Emukai et al. | |
| 2001/0031161 | A1* | 10/2001 | Nakazato | 399/388 |
| 2013/0195482 | A1* | 8/2013 | Nakura et al. | 399/45 |

FOREIGN PATENT DOCUMENTS

| | | |
|---|---|---|
| JP | 01-280782 | 11/1989 |
| JP | 06-138779 | 5/1994 |
| JP | 07-140740 | 6/1995 |
| JP | 11-052757 | 2/1999 |
| JP | 3025070 | 3/2000 |
| JP | 2005-015217 | 1/2005 |
| JP | 2005-106918 | 4/2005 |
| JP | 2008-026650 | 2/2008 |
| JP | 2008-040289 | 2/2008 |
| JP | 2009-067561 | 4/2009 |
| JP | 2009-086440 | 4/2009 |
| JP | 4355461 | 11/2009 |
| JP | 4428872 | 3/2010 |

* cited by examiner

*Primary Examiner* — Jeremy R Severson
(74) *Attorney, Agent, or Firm* — IPUSA, PLLC

(57) ABSTRACT

A disclosed sheet carrying device includes a first carrying unit that includes a first rotary body, a first driving unit outputting a driving force at a first peripheral speed, a one-way clutch transmitting the driving force only in a sheet carrying direction, and a second rotary body driven by the first rotary body via the sheet; and a second carrying unit including a third rotary body rotating at a second peripheral speed being the first peripheral speed or more, a fourth rotary body carrying the sheet with the third rotary body, a second driving unit outputting a driving force for driving the fourth rotary body at a third peripheral speed being the second peripheral speed or more, and a torque limiter having a slip torque smaller than a sheet carrying torque and cutting off the driving force while the sheet is interposed between the third and fourth rotary bodies.

7 Claims, 10 Drawing Sheets

SHEET CARRYING DEVICE AND IMAGE FORMING APPARATUS

BACKGROUND OF THE INVENTION

1. Field of the Invention

The present invention relates to a sheet carrying device and an image forming apparatus including the sheet carrying device.

2. Description of the Related Art

In a commercial print industry, small lot printing, many print types, variable data printing, or the like are becoming more frequently performed by a document printer using an electrophotographic method, which is called Print On Demand (POD), than by a conventional offset printer. In order to deal with various needs such as those described above, front and back registering accuracy, image evenness, or the like, comparable to that of an offset printer is required for the electrophotographic document printers.

Factors causing a front and back register gap in the electrophotographic document printer are registration error in the longitudinal and lateral directions, skew error between a sheet and a print image, and image expansion and contraction on a sheet caused in a toner transferring unit. Image expansion and contraction on the sheet caused in the toner transferring unit disturbs image evenness to be one of factors causing an abnormal image such as banding.

Image expansion and contraction in the toner transferring unit is caused by incorrect transfer of a toner image formed on a photoreceptor drum, an intermediate transferring belt, or the like depending on variation of the sheet carrying speed, at which an image is transferred in the toner transferring unit.

FIG. 10 illustrates a schematic structure of an image forming apparatus 110 of the related art. The image forming apparatus 110 includes a photoreceptor drum 13, a transferring roller 14, a fixing unit 50, or the like. A toner image is formed on a surface of a sheet S.

The sheet S is interposed between a driving roller 12 which is rotated by a motor 31 and a driving mechanism and a driven roller 11 which is rotated by contacting the driving roller 12 so as to be carried. The sheet S is further carried between the photoreceptor drum 13 which is rotated by a motor 32 and a transferring roller 14 which is rotated by a motor 33. A toner image formed on the surface of the photoreceptor drum 13 is transferred to the sheet S in a transferring portion between the photoreceptor drum 13 and the transferring roller 14. Simultaneously, the sheet S is further interposed between the photoreceptor drum 13 and the transferring roller 14 so as to be carried to a fixing unit 50 by a carrying belt 23. The toner image is fixed by applying heat and pressure to the surface of the sheet S, which is carried by the fixing unit 50, at a time of passing through a space between a heat roller 51 and a pressure roller 52. The sheet S having the toner image fixed to it is ejected out of the electrophotopgraphic document printer.

At the time of transferring the toner image, the sheet S is interposed between the driven roller 11 and the driving roller 12 and also between the photoreceptor drum 13 and the transferring roller 14 so as to be carried, or interposed between the photoreceptor drum 13 and the transferring roller 14 so as to be carried. Therefore, the carrying speed of the sheet S is determined by the peripheral speeds of the driving roller 12, the photoreceptor drum 13, and the transferring roller 14.

If the carrying speed of the sheet S varies while the toner image is being transferred, an abnormal image such as banding may be produced as described above. Therefore, it is necessary to maintain the carrying speed evenly by minutely adjusting each of the peripheral speeds of the driving roller 12, the photoreceptor drum 13, and the transferring roller 14. However, a friction coefficient on the surface of the photoreceptor drum 13 may be changed by a toner adhesion amount. An influence on the carrying speed of the sheet S varies depending on the change of the friction coefficient, an environmental change of temperature and humidity or the like, a temporal change of various rollers, or the like. Therefore, it is difficult to stabilize the carrying speed of the sheet S by minutely adjusting peripheral speeds of the various portions depending on the above complicated changes.

There is an example where, while the sheet S is interposed between the driven roller 11 and the driving roller 12 and also between the photoreceptor drum 13 and the transferring roller 14 so as to be carried, a torque limiter is provided in a driving mechanism of the driving roller 12 so that the driving roller is driven to rotate by the sheet (for example, Patent Document 1 or 2). When the sheet S is interposed between the driven roller 11 and the driving roller 12 and also between the photoreceptor drum 13 and the transferring roller 14 so as to be carried, the torque limiter is provided to cut off the driving force from the motor 31 to the driving roller 12 by slippage in the torque limiter. Thus, the driving motor 31 is driven to rotate by the sheet S. With this structure, it is possible to reduce the influence of the driving roller 12 on the carrying speed of the sheet S in transferring the toner thereby stabilizing the carrying speed of the sheet S.

There is an example structure where a torque limiter is provided in a driving mechanism of the transferring roller 14 to cause the torque limiter to slip while the transferring roller 14 contacts the photoreceptor drum 13 for cutting off driving force from the motor 33 to the transferring roller 14. In this structure, the transferring roller 14 is driven to rotate by the photoreceptor drum 13 (for example, Patent Document 3). With this structure, an influence of the transferring roller 14 on the carrying speed of the sheet S is reduced. Thus, the variation of sheet carrying speed in transferring a toner image to the sheet S can be reduced.

However, in the above structure of the driving mechanism of the driving roller 12 having the torque limiter, the carrying speed of the sheet S depends on any one of peripheral speeds of the photoreceptor drum 13 and the transferring roller 14. Therefore, there may be a case where it is difficult to carry the sheet S at an accurately uniform speed depending on the toner adhesion amount on the photoreceptor drum 13, environmental change, temporal change, or the like.

Further, in a case where the torque limiter is provided in the driving mechanism of the transferring roller 14, while the sheet S is interposed between the driven roller 11 and the driving roller 12 and also between the photoreceptor drum 13 and the transferring roller 14, there is a probability that the carrying speed of the sheet S is not stabilized by an influence from the driving roller 12.

Patent Document 1: Japanese Laid-Open Patent Application No. 07-140740

Patent Document 2: Japanese Laid-Open Patent Application No. 2005-15217

Patent Document 3: Japanese Laid-Open Patent Application No. 11-52757

SUMMARY OF THE INVENTION

Accordingly, embodiments of the present invention provide a novel and useful sheet carrying device solving one or more of the problems discussed above.

One aspect of the embodiments of the present invention may be to provide a sheet carrying device which carries a sheet including a first carrying unit, and a second carrying unit, wherein the sheet is transferred from the first carrying unit to the second carrying unit, wherein the first carrying unit includes a first rotary body, a first driving unit that outputs a driving force for driving to rotate the first rotary body at a first peripheral speed, a one-way clutch that transmits the driving force output by the first driving unit to the first rotary body only in a direction in which the first rotary body carries the sheet, a second rotary body that is driven to rotate by the first rotary body via the sheet while the sheet is interposed between the first rotary body and the second rotary body, wherein the second carrying unit includes a third rotary body that rotates at a second peripheral speed equal to or faster than the first peripheral speed, a fourth rotary body that carries the sheet while the sheet is interposed between the third rotary body and the fourth rotary body, a second driving unit that outputs a driving force for driving to rotate the fourth rotary body at a third peripheral speed equal to or faster than the second peripheral speed, and a torque limiter that has a slip torque smaller than a torque for carrying the sheet while the sheet is interposed between the third rotary body and the fourth rotary body and cuts off the driving force output by the second driving unit while the sheet is interposed between the third rotary body and the fourth rotary body so as to be carried.

Additional objects and advantages of the embodiments will be set forth in part in the description which follows, and in part will be clear from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to the FIG. 1 through FIG. 9, of embodiments of the present invention.

Where the same reference symbols are attached to the same parts, repeated description of the parts may be omitted.

Reference symbols typically designate as follows:

1: first carrying unit;
2: second carrying unit;
3: start trigger sensor (downstream detecting unit);
4: stop trigger sensor (upstream detecting unit);
11: driven roller (first rotary body);
12: driving roller (second rotary body);
13: photoreceptor drum (third rotary body);
14: transferring roller (fourth rotary body);
15: intermediate transferring belt;
16: pulse counting unit;
17: carrying distance calculating unit;
31: motor (first driving unit);
33: motor (second driving unit);
41: one-way clutch;
42: torque limiter (second torque limiter);
43: torque limiter (first torque limiter);
61, 62, 64: roller;
100: sheet carrying device;
101, 102, 103: image forming apparatus; and
P: paper (sheet).

First Embodiment

<Structure of Image Forming Apparatus>

Figure 1:
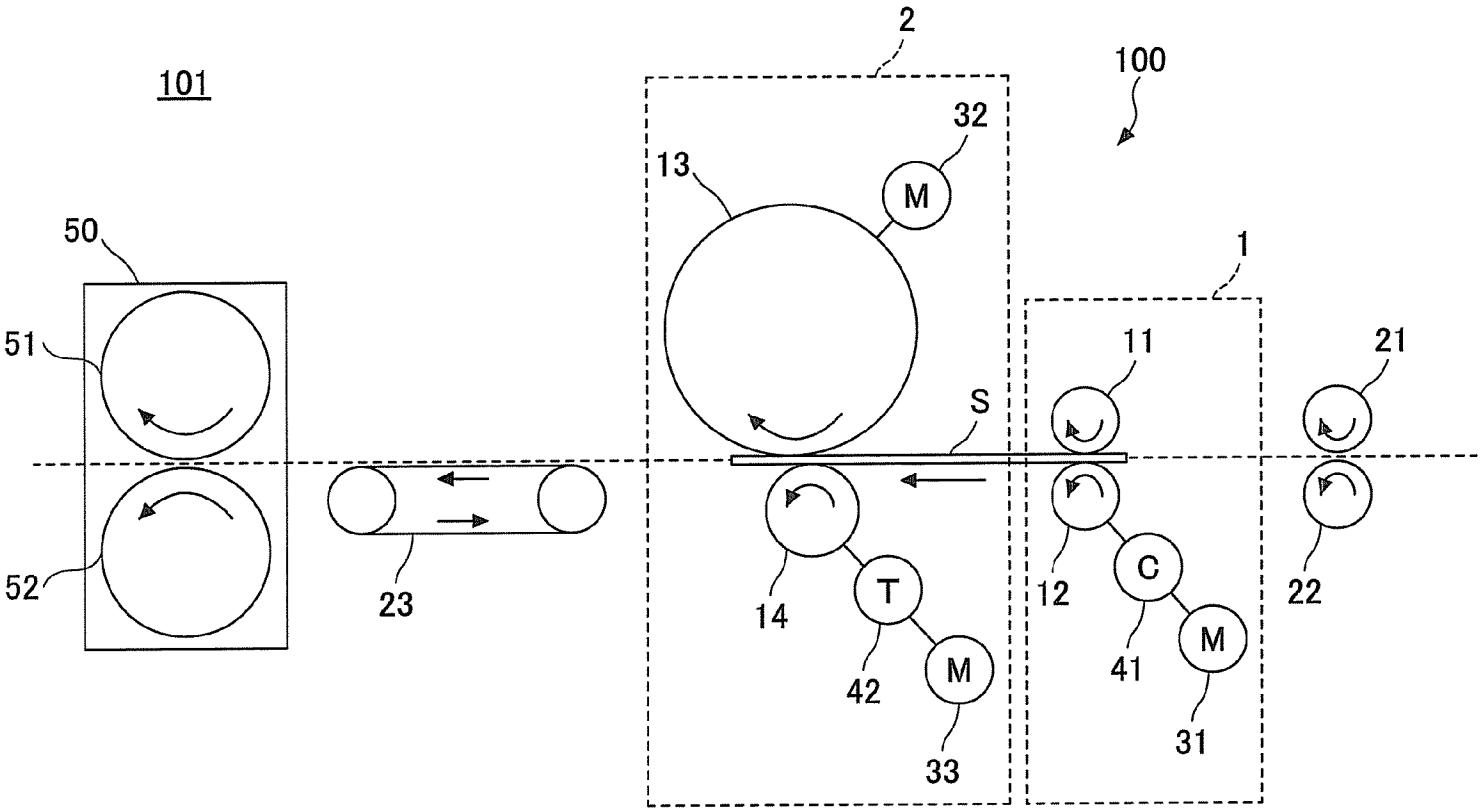
FIG. 1 illustrates a schematic structure of an image forming apparatus of a first embodiment.

FIG. 1 illustrates a schematic structure of an image forming apparatus of a first embodiment.

The image forming apparatus 101 includes a photoreceptor drum 13, a transferring roller 14, a fixing unit 50, or the like, and forms a monochromatic toner image on a sheet S such as a paper or an OHP carried by a driven roller 11, a driving roller 12, a carrying belt 23, or the like.

Around the photoreceptor drum 13, a charging device, an exposure device, a developing device, a cleaning device, or the like, which are not illustrated, are provided. The photoreceptor drum 13 is connected via a driving mechanism to a motor as a driving unit. The photoreceptor drum 13 is driven to rotate in the direction of the arrow direction at a predetermined peripheral speed.

At the time of forming an image, at first, the surface of the photoreceptor drum 13, which is driven to rotate, is uniformly charged by a charging device. The exposure device forms an electrostatic latent image by exposing the surface of the photoreceptor drum 13 to light based on image data to be printed. Toner is applied by the developing device, which accommodates a developer, to the electrostatic latent image formed on the surface of the photoreceptor drum 13 so that the electrostatic latent image is visualized. The toner image on the surface of the photoreceptor drum 13 is transferred to the sheet S by a transferring portion between the photoreceptor drum 13 and the transferring roller 14. After transferring the toner image on the surface of the photoreceptor drum 13 to the sheet S, the toner left on the surface is removed by the cleaning device. Then, the photoreceptor drum 13 is provided for next image formation.

The sheet having the transferred toner image on its surface is carried by the carrying belt 23 to the fixing unit 50. The toner image is fixed on the surface of the sheet S while the sheet S passes through a space between the heat roller 51 and the pressure roller 52. The sheet S having the fixed toner image is further carried and ejected outside the image forming apparatus 101. By the above described processes, the image forming apparatus 101 can print a monochromatic image on the surface of the sheet S and outputs the printed sheet.

<Carrying Sheet>

Next, a carrying mechanism of the sheet S in the image forming apparatus 101 is described.

The sheets S are extracted one by one from a paper tray (not illustrated) at a time of forming an image, and carried by paired rollers 21 and 22 or the like. The sheet S carried by the paired rollers 21 and 22 is handed from a first carrying unit 1 including the driven roller 11 and the driving roller 12 to a second carrying unit 2 including the photoreceptor drum 13 and the transferring roller 14. The sheet S is further transferred by a carrying belt 23 and a fixing unit 50, and ejected outside the image forming apparatus 101. As described, the image forming apparatus 101 prints an image on the sheet S carried by a sheet carrying device 100 including the first carrying unit 1 and the second carrying unit 2, the paired rollers 21 and 22, the carrying belt 23, and so on.

The first carrying unit 1 includes the driven roller 11, the driving roller 12, a one-way clutch 41, a motor 31 as a driving unit for the driving roller 12, and so on.

The driving roller 12 is driven to rotate by receiving a driving force of the motor 31 via a driving mechanism. The driven roller 11 is driven to rotate by interposing the sheet S between the driven roller 11 and the driving roller 12. The one-way clutch 41 is provided in the driving mechanism between the driving roller 12 and the motor 31. The one-way clutch 41 transfers the driving force output by the motor 31 in a rotational direction for carrying the sheet S by the driving roller 12 (the arrow direction of the driving roller 12 in FIG. 1. The one-way clutch 41 idles to cut off the driving force output by the motor 31 in a rotational direction for backward carrying the sheet S.

The first carrying unit 1 receives the sheet S from the paired rollers 21 and 22 on the upstream side in the carrying direction of the sheet S. The driving roller 12 rotates at a predetermined peripheral speed along with a driven roller 11 to carry the sheet S so that the leading edge of the sheet S enters a transferring portion between the photoreceptor drum 13 and the transferring roller 14.

It is preferable that the driven roller 11 and the driving roller 12 are in contact and rotate at equal speeds immediately before transferring the sheet S so that the sheet S is interposed between the driven roller 11 and the driving roller 12 so that the sheet S is carried. A contact and separation mechanism may be provided so that the driven roller 11 is separated from the driving roller 12. The driven roller 11 and the driving roller 12 are separated at a time of carrying no sheet between carried sheets S. The driven roller 11 contacts the driving roller 12 immediately before carrying the sheet S.

The second carrying unit 2, to which the sheet S is sent from the first carrying unit 1, includes a photoreceptor drum 13, a transferring roller 14, motors 32 and 33 as a driving unit, a torque limiter 42, or the like.

The photoreceptor drum 13 is connected to the motor 32 via a driving mechanism. The photoreceptor drum 13 is driven to rotate by receiving driving force of the motor 32. The transferring roller 14 is connected to the motor 33 via a driving mechanism. The transferring roller 14 is driven to rotate by receiving driving force of the motor 33. The torque limiter 42 is provided in the driving mechanism between the transferring roller 14 and the motor 33. The torque limiter 42 transfers the driving force of the motor 33 to the transferring roller 14 within a range of limited load torque. When the load torque exceeds a predetermined value, the torque limiter 42 slips and cuts off the driving force of the motor 33 to the transferring roller 14.

Further, a contact and separation mechanism (not illustrated) is provided in the transferring roller 14. When the image is not being formed, the transferring roller 14 is separated from the photoreceptor drum 13. When the toner image is transferred to the sheet S, the transferring roller 14 contacts the photoreceptor drum 13 via the sheet S.

In the second carrying unit 2, the sheet S is interposed between the photoreceptor drum 13 and the transferring roller 14 so as to be carried, and simultaneously the toner image formed on the photoreceptor drum 13 is transferred to the sheet S by the transferring portion between the photoreceptor drum 13 and the transferring roller 14.

The toner image is transferred to the sheet S after the sheet S is sent from the first carrying unit 1 to the second carrying unit 2 and until the sheet S is ejected from the second carrying unit 2. By evenly maintaining the carrying speed of the sheet S in the sheet carrying device 100 including the first carrying unit 1 and the second carrying unit 2, it is possible to prevent an abnormal image effect such as banding caused by image expansion and contraction on the sheet at the time of transferring the image from occurring.

A carrying route of the sheet S extends from the first carrying unit 1 to the second carrying unit 2. Although the carrying route of the sheet may be shaped so as to bend, it is preferable to make the shape linear. This is because the linear carrying route is advantageous to stabilize the sheet carrying speed.

In the above carrying mechanism of the sheet S, a carrying unit for carrying the sheet S from a paper tray (not illustrated) to the first carrying unit 1 may be structured by providing plural paired rollers, a carrying belt, or the like in addition to the paired rollers 21 and 22. A carrying unit between the second carrying unit 2 and the fixing unit 50 is not limited to the carrying belt 23. For example, the paired rollers, in which one of the rollers is driven to rotate, or the like may be used. Further, a guide member for guiding the carried sheet S may be provided between the paired rollers 21 and 22 and the first carrying unit 1 and between the first carrying unit 1 and the second carrying unit 2. The guide member may guide the carried sheet S on one side of the sheet S or on both sides of the sheet S.

Further, in the structure of the embodiment illustrated in FIG. 1, in a case where a registration correcting unit for correcting a registration of the sheet S and a length measuring unit for measuring the length of the sheet S are provided, the registration correcting unit (e.g., paired rollers, a guide, or the like) may be provided on the upstream side of the paired rollers 21 and 22 so that the paired rollers are used as the length measuring unit for measuring the length of the sheet S. Alternatively, the paired rollers 21 and 22 may also function as the registration correcting unit, and the driven roller 11 and the driving roller 12 in the first carrying unit 1 may also function as the length measuring unit for measuring the sheet S. In either case, there are provided an encoder for measuring the number of rotations of one of the paired rollers (the paired rollers 21 and 22, or the driven roller 11 and the driving roller 12), and a sensor for detecting the sheet S may be provided on the upstream and/or downstream side of the paired rollers. With this structure, it becomes possible to measure the carrying distance of the sheet S in the carrying direction or the length of the sheet S in the carrying direction based on a detection time interval between a time detected at the leading edge of the sheet S and a time detected at the trailing edge, and the number of rotations of the roller in the detection time interval.

<About Sheet Carrying Speed>

Next, a setup of the driving roller 12 of the first carrying unit 1, a setup of the peripheral speeds of the photoreceptor drum 13 and the transferring roller 14 of the second carrying unit 2 and the one-way clutch 41, a setup of the torque limiter 42 or the like is described. Further, the carrying speed of the sheet S in transferring toner image onto the sheet S is described.

In the first carrying unit 1, the motor 31 outputs driving force to drive to rotate the driving roller 12 at a peripheral speed Va. While the sheet S is carried only by the driven roller 11 and the driving roller 12, the driving mechanism including the one-way clutch 41 transmits the driving force of the motor to the driving roller 12. Thus, the driving roller 12 is rotated at the peripheral speed Va to thereby carry the sheet at the speed Va. However, while the sheet S is interposed between the driven roller 11 and the driving roller 12 and also between the photoreceptor drum 13 and the transferring roller 14 in the second carrying unit 2 so as to be carried, the sheet S may be carried at a speed Va or faster by the second carrying unit 2 on the downstream side. In this case, the driving roller 12 is driven to rotate by the sheet S thereby causing the one-way clutch 41 to idle. Because of idling of the one-way clutch 41, the driving force of driving roller 12 is cut off from the motor 31. Then, the driving roller 12 is driven to rotate by the sheet S together with the driven roller 11.

In the second carrying unit 2, the photoreceptor drum 13 is provided to be driven to rotate at a peripheral speed Vb (≥Va) by the motor 32. Further, the motor 33 outputs a driving force for driving to rotate the transferring roller at a peripheral speed Vc (≥Vb) by the motor 33.

A slip torque Ts of the torque limiter 42 provided in the driving mechanism between the transferring roller 14 and the motor 33 is set to be a value Ts (To<Ts<Tc) between a load torque To and a load torque Tc. The load torque To is obtained when the photoreceptor drum 13 and the transferring roller 14 are separated. The load torque Tc is obtained when the photoreceptor drum 13 and the transferring roller 14 contact. Therefore, in a state where the transferring roller 14 is separated from the photoreceptor drum 13, the load torque To of the torque limiter 42 is less than a slip torque Ts. Therefore, the torque limiter 42 transfers the driving force of the motor 33 to the transferring roller 14. The transferring roller 14 is driven to rotate at the peripheral speed Vc. Further, while the transferring roller 14 contacts the photoreceptor drum 13, the load torque Tc exceeds the slip torque Ts. Therefore, the torque limiter 42 cuts off the driving force from the motor 33, and the transferring roller 14 is driven to rotate at the peripheral speed Vb by the photoreceptor drum 13.

With the above mentioned structure, the carrying speed of the sheet S in the sheet carrying device 100 for each of carrying states of the sheets is described with reference to FIGS. 2A to 2C.

<State A>: FIG. 2A

<State A> is a carrying state where the sheet S is interposed between the driven roller 11 and the driving roller 12 in the first carrying unit 1 so as to be carried before a toner image is transferred to the sheet S.

In this <State A>, the sheet S is interposed between the driving roller 12 rotating at the peripheral speed Va by receiving the driving force of the motor 31 and the driven roller 11 driven to rotate by the driving roller 12 so as to be carried at the speed Va.

<State B>: FIG. 2B

<State B> is a state where a part of the sheet S in the downstream side in the carrying direction is interposed between the photoreceptor drum 13 and the transferring roller 14 in the second carrying unit 2, and a part of the sheet S in the upstream side in the carrying direction is interposed between the driven roller 11 and the driving roller 12. In <State B>, the toner image has begun to be transferred to the sheet S.

In <State B>, the photoreceptor drum 13 rotates at the peripheral speed Vb. When the transferring roller 14 contacts the photoreceptor drum 13 to cause the load torque Tc of the torque limiter 42 to exceed the slip torque Ts, the torque limiter 42 cuts off the driving force of the motor 33. Then, the transferring roller 14 is driven by the photoreceptor drum 13 so as to rotate at the peripheral speed Vb.

After the leading edge of the sheet S, which has been carried at the peripheral speed Va of the driving roller 12, enters between the photoreceptor drum 13 and the transferring roller 14 in <State A>, the sheet S is carried at the speed Vb by the photoreceptor drum 13 and the transferring roller 14, which rotate at the peripheral speed Vb faster than the peripheral speed Va of the driving roller 12. At this time, in the first carrying unit 1, the one-way clutch 41 idles. Therefore, the driven roller 11 and the driving roller 12 are driven by the sheet S to rotate at the peripheral speed Vb, as described above.

<State C>: FIG. 2C

In <State C>, the trailing edge of the sheet on the upstream side in the carrying direction is separated from the driven roller 11 and the driving roller 12 of the first carrying unit 1. The sheet S is interposed only between the photoreceptor drum 13 and the transferring roller 14 of the second carrying unit 2 so as to be carried while the toner image is continuously transferred to the sheet.

In <State C>, in a manner similar to <State B>, the sheet S is carried at the speed Vb by the photoreceptor drum 13 and the transferring roller 14, which rotate at the peripheral speed Vb.

Between <State B> and <State C>, wherein the toner image formed on the photoreceptor drum 13 is transferred to the sheet S, the sheet S is carried at the constant speed Vb in conformity with the peripheral speed Vb of the photoreceptor drum 13. Therefore, since the sheet carrying speed at the time of transferring the toner is constantly maintained in the sheet carrying device 100, it is possible to prevent an abnormal image such as banding from occurring. Thus, the image forming apparatus 101 can form an even image.

Figure 2A:
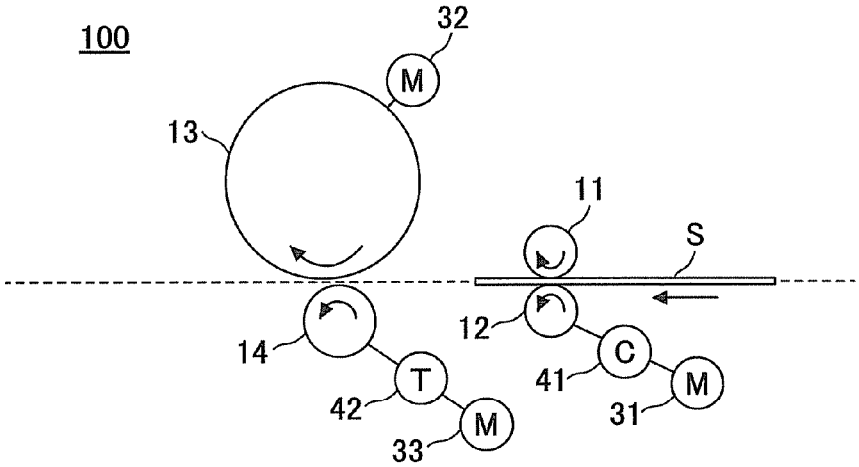
FIG. 2A illustrates a sheet carrying state of the first embodiment.
Figure 2B:
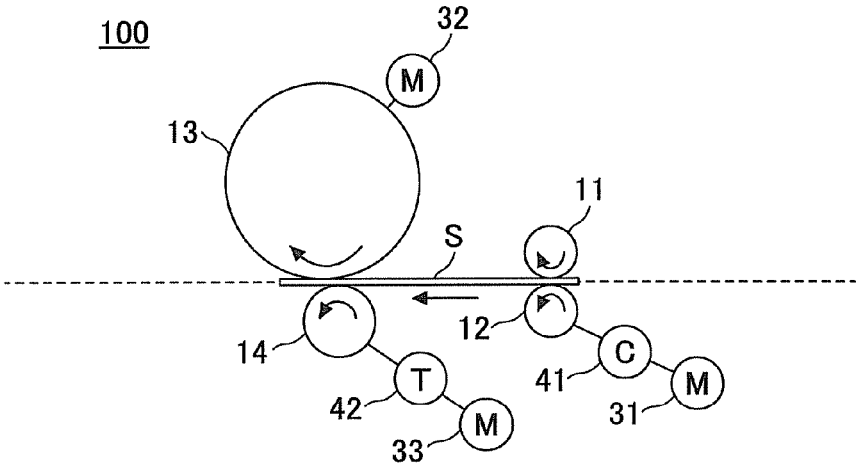
FIG. 2B illustrates another sheet carrying state of the first embodiment.
Figure 2C:
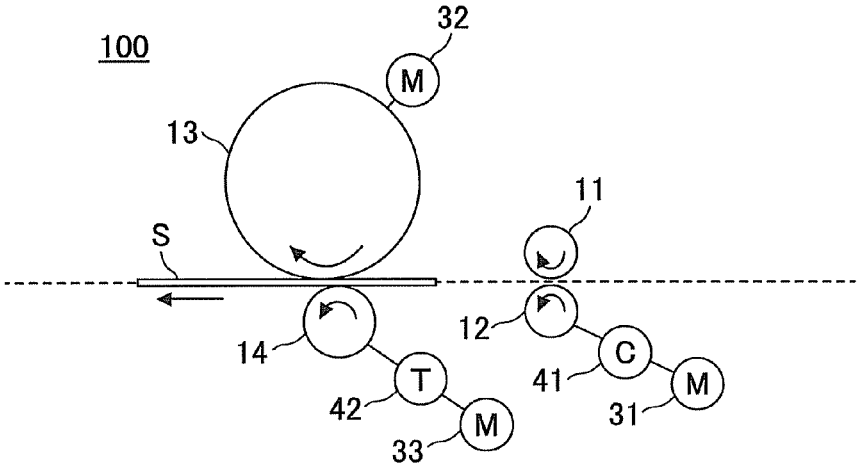
FIG. 2C illustrates another sheet carrying state of the first embodiment.

In the states illustrated in FIGS. 2A to 2C, when the sheet S is not carried, the driven roller 11 may be separated from the driving roller 12, and the photoreceptor drum 13 may be separated from the transferring roller 14. However, before the sheet S is carried, it is preferable to cause the opposing rollers to contact each other.

Within the first embodiment, the above effect is obtainable when the peripheral speed Va of the driving motor set to the motor 31, the peripheral speed Vb of the photoreceptor drum 13 by the motor 32, and the peripheral speed Vc set to the motor 33 satisfy the following formula (1).

$$Va \leq Vb \leq Vc \qquad \text{Formula 1}$$

However, if a difference between the peripheral speeds Va and Vb or a difference between the peripheral speeds Vb and Vc is large, the slipping amount of the one-way clutch 41 or of the torque limiter 42, respectively, becomes large while the sheet is carried. Then, operating lives of the one-way clutch 41 or the torque limiter 42 is shortened by heat and wear caused by the large slipping amount. Therefore, the difference between the peripheral speeds is preferably small. It is further preferable that the peripheral speeds are set to be the same. However, when the peripheral speeds of the driving roller 12, the photoreceptor drum 13, and the transferring roller 14 vary, due to environmental variation of temperature and humidity or the like, such that Formula 1 is not satisfied, the above effect is not obtained thereby causing the carrying speed of the sheet to vary at the time of transferring toner. If the carrying speed of the sheet S varies at the time of transferring toner, image expansion and contraction may occur. Therefore, it is preferable to provide predetermined margins between the peripheral speed Va and the peripheral speed Vb and between the peripheral speed Vb and the peripheral speed Vc, respectively.

Therefore, it is preferable that the peripheral speeds Va, Vb, and Vc satisfy the following formula 2 and formula 3.

$$0.90Vb \leq Va \leq 0.99Vb \quad \text{Formula 2}$$

$$1.001Vb \leq Vc \leq 1.05Vb \quad \text{Formula 3}$$

Further, in order to prevent the operation life of the one-way clutch 41 or the torque limiter 42 from shortening and stably obtain the above effect in consideration with the environmental variation or the like, it is preferable that the peripheral speeds Va, Vb, and Vc satisfy the following Formula 4 and Formula 5.

$$0.95Vb \leq Va \leq 0.99Vb \quad \text{Formula 4}$$

$$1.001Vb \leq Vc \leq 1.02Vb \quad \text{Formula 5}$$

As described above, within the first embodiment, it is possible to maintain the sheet carrying speed in transferring the toner image to the sheet S to be constant in the sheet carrying device 100. The image forming apparatus 101 can form and output an even image on the sheet S by preventing the abnormal image such as banding from occurring.

Second Embodiment

Next, a second embodiment is described with reference to figures. Where the same reference symbols are attached to the same parts, repeated description of the parts may be omitted.

Figure 3:
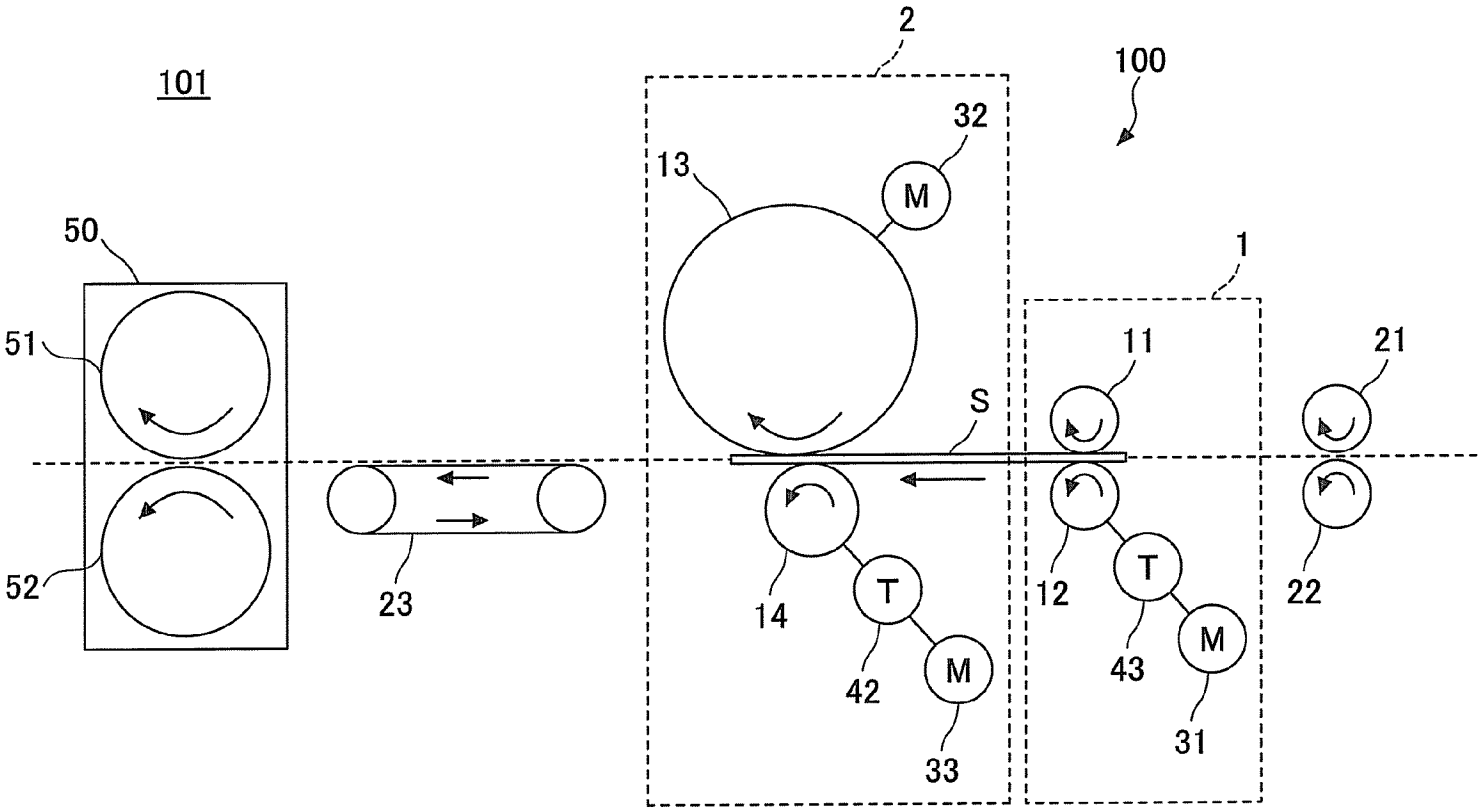
FIG. 3 illustrates a schematic structure of an image forming apparatus of a second embodiment.

FIG. 3 exemplifies a schematic structure of the image forming apparatus 101 of the second embodiment. The image forming apparatus 101 of the second embodiment differs from the image forming apparatus 101 of the first embodiment in that a torque limiter 43 is provided in the driving mechanism between the driving roller 12 of the first carrying unit 1 and the motor 31.

The image forming apparatus 101 includes a photoreceptor drum 13, a transferring roller 14, a fixing unit 50, or the like. A toner image is formed on a surface of a sheet S.

The sheet S is carried by the first carrying unit 1 and the second carrying unit 2 of the sheet carrying device 100. After the toner image is transferred onto the surface of the sheet S in a transferring portion between the photoreceptor drum 13 and the transferring roller 14, the toner image on the surface of the sheet S is fixed when the sheet S passes through the fixing unit 50 and the sheet S is ejected.

The first carrying unit 1 includes the driven roller 11, the driving roller 12, the torque limiter 43, a motor 31 as a driving unit for the driving roller 12, and so on.

The driving roller 12 is driven to rotate by receiving driving force of the motor 31 via a driving mechanism. The driven roller 11 is driven to rotate by interposing the sheet S between the driven roller 11 and the driving roller 12. A torque limiter 43 is provided in the driving mechanism between the transferring roller 12 and the motor 31.

In a manner similar to the first embodiment, the second carrying unit 2 includes the photoreceptor drum 13, the transferring roller 14, motors 32 and 33 as driving units, a torque limiter 42, and so on.

The motor 31 of the first carrying unit 1 outputs a driving force of driving to rotate the driving roller 12 at the peripheral speed Va. The driving roller 12 is driven to rotate by receiving the driving force via the torque limiter 43 or the like. The sheet S is interposed between the driving roller 12 and the driven roller 11 so as to be carried.

The torque limiter 43 transfers the driving force of the motor 31 to the driving roller 12 within a range of limited load torque. When the load torque exceeds a predetermined value, the torque limiter 43 slips and cuts off the driving force of the motor 31 to the driving roller 12. The slip torque Ts2 of the torque limiter 43 is set to be between adverse load torque To2 and adverse load torque Tc2 (To2<Ts2<Tc2). The adverse load torque To2 is applied to the driving roller 12 in a direction adverse to the carrying direction of the sheet S in <State A> where the sheet S is carried only by the driven roller 11 and the driving roller 12. The adverse load torque Tc2 is applied to the driving roller 12 in a direction adverse to the carrying direction of the sheet S in <State B> where the sheet S is carried by the driven roller 11 and the driving roller 12 and also by the photoreceptor drum 13 and the transferring roller 14.

Within the above described structure, in <State A> where the sheet S is carried only by the driven roller 11 and the driving roller 12, the adverse load torque To2 of the torque limiter 43 is less than the slip torque Ts2. The driving force is transmitted from the motor 31 to rotate the driving roller 12 at the peripheral speed Va. The sheet S is interposed between the driving roller 12 and the driven roller 11 so as to be carried at the speed Va.

The photoreceptor drum 13 in the second carrying unit 2 is provided to be driven to rotate by the motor 32 at the peripheral speed Vb (Vb≥Va). Further, the transferring roller 14 includes a contact and separation mechanism causing the transferring roller 14 to contact or separate from the photoreceptor drum 13. The motor 33 generates driving force for driving to rotate the transferring roller 14 at the peripheral speed Vc (Vc≥Vb). The torque limiter 42 provided in the driving mechanism between the motor 33 and the transferring roller 14 transmits the driving force of the motor 33 in a range of the limited load torque to the transferring roller 14.

In <State B>, a part of the sheet S on the downstream side in the carrying direction of the sheet S is interposed between the photoreceptor drum 13 and the transferring roller 14 and a part of the sheet S on the upstream side in the carrying direction of the sheet S is interposed between the driven roller 11 and the driving roller 12 so that the sheet S is carried at the peripheral speed Vb of the photoreceptor drum 13 and the transferring roller 14. At this time, the adverse load torque Tc2 of the torque limiter 43 exceeds the slip torque Ts2, the torque limiter 43 cuts off the driving force from the motor 31, and the driving roller 12 is driven by the sheet S to rotate at the peripheral speed Vb. As described, in <State B>, the photoreceptor drum 13, the transferring roller 14, and the driving roller 12 rotate at the peripheral speed Vb to thereby carry the sheet S at the speed Vb.

In <State C> where the sheet S is transferred only by the photoreceptor drum 13 and the transferring roller 14, the photoreceptor drum 13 and the transferring roller 14 sequentially rotate at the peripheral speed Vb to thereby carry the sheet S at the speed Vb.

As described, between <State B> and <State C>, wherein the toner image formed on the photoreceptor drum 13 is transferred to the sheet S, the sheet S is carried at the constant speed Vb in the sheet carrying device. Therefore, the image forming apparatus 101 can prevent an abnormal image such as banding, which is caused by variation of the carrying speed of the sheet S in transferring the toner, from occurring to thereby enable forming an even image.

Third Embodiment

Next, a third embodiment is described with reference to figures. Where the same reference symbols are attached to the same parts, repeated description of the parts may be omitted.

Figure 4:
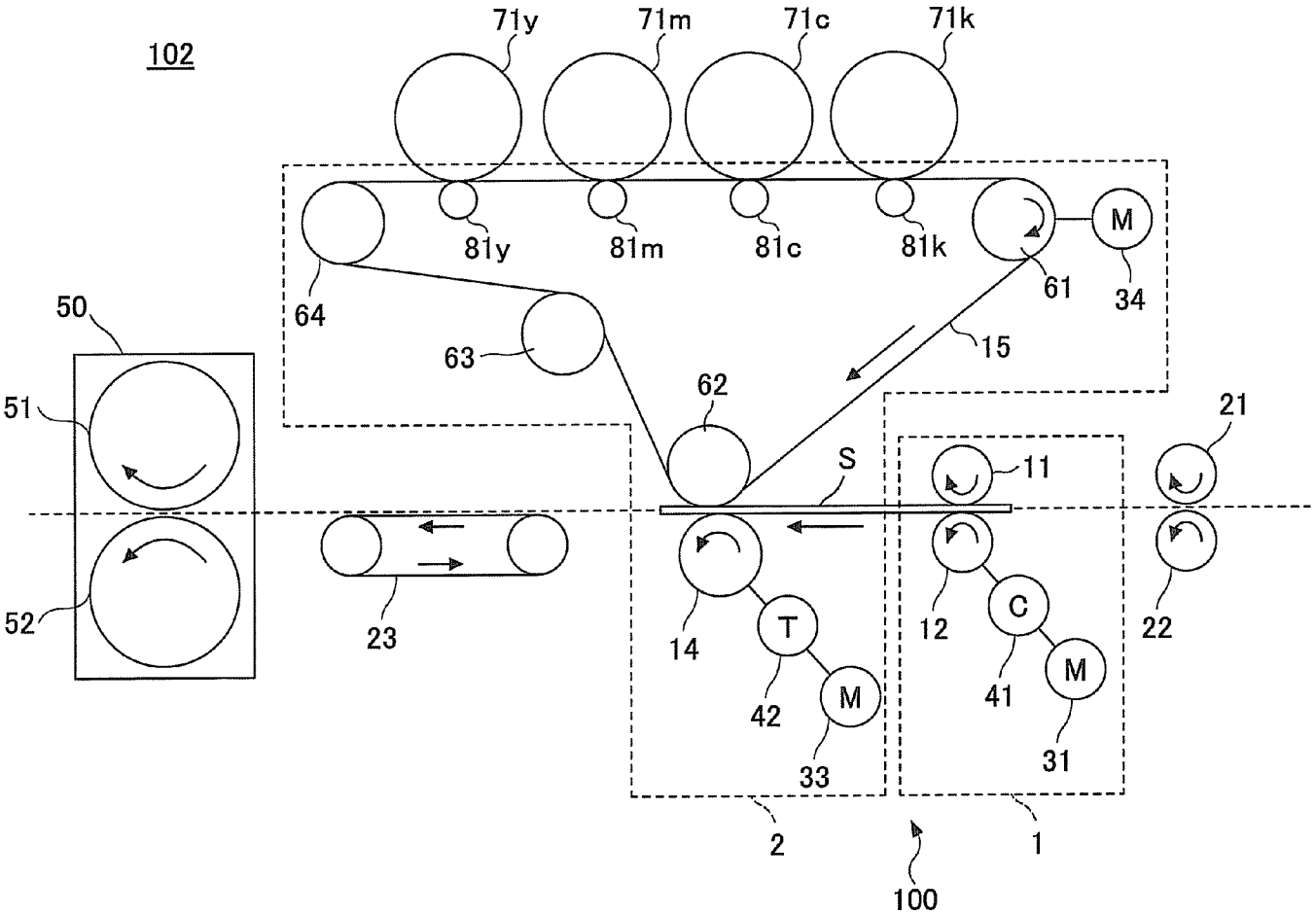
FIG. 4 illustrates a schematic structure of the image forming apparatus of a third embodiment.

FIG. 4 illustrates a schematic structure of an image forming apparatus 102 of the third embodiment. The image forming apparatus 102 of the third embodiment differs from the image forming apparatus 101 of the first embodiment in that plural photoreceptor drums 71*k*, 71*c*, 71*m*, and 71*y*, an intermediate transferring belt 15, and so on are provided so as to form a color image.

A charging device, an exposure device, and a developing device are provided around each of the photoreceptor drums 71*k*, 71*c*, 71*m*, and 71*y*. The photoreceptor drums 71*k*, 71*c*, 71*m*, and 71*y* form toner images of different colors such as black, cyan, magenta, and yellow.

The intermediate transferring belt 15 is an endless belt bridged among plural rollers 61 to 64. The intermediate transferring belt 15 is rotated in an arrow direction by the roller 61, which is rotated by the motor 34.

The toner images of various colors formed on the photoreceptor drum 71*k*, 71*c*, 71*m*, and 71*y* are transferred to the intermediate transferring belt 15 at interfaces between the photoreceptor drum 71*k*, 71*c*, 71*m*, and 71*y* and transferring rollers 81*k*, 81*c*, 81*m*, and 81*y*, respectively. Thus, a full color toner image is formed.

The full color toner image formed on the intermediate transferring belt 15 is carried by the rotating intermediate transferring belt 15. In a secondary transferring portion provided between a transferring roller 14 and the roller 62 facing the transferring roller 14, the full color toner image is transferred to the sheet S carried by the intermediate transferring belt 15. The sheet S to which the full color toner image has been transferred is carried by a carrying belt 23 or the like. When the sheet S passes through a fixing unit 50, heat and pressure are applied to the sheet S. Thus, the sheet S to which the toner image is fixed is ejected outside the image forming apparatus 102.

The toner image is transferred to a surface of the sheet S while the sheet S is carried by a first carrying unit 1, which includes a driven roller 11, a driving roller 12, a one-way clutch 41, a motor 31 and so on, and by a second carrying unit 2, which includes the intermediate transferring belt 15, motors 33 and 34, a transferring roller 14, a torque limiter 42, and so on.

The motor 31 of the first carrying unit 1 outputs a driving force so that the driving roller 12 can be driven to rotate at a peripheral speed Va. The one-way clutch 41, which is provided in a driving mechanism between the motor 31 and the driving roller 12, transmits a driving force of the motor 31 in the carrying direction of the sheet S.

The intermediate transferring belt 15 of the second carrying unit 2 is driven to rotate at a peripheral speed Vb (Vb≥Va) by the roller 61, which is connected to the motor 34 so as to be driven to rotate by the motor 34. The transferring roller 14 faces the roller 62 via the intermediate transferring belt 15. The transferring roller 14 includes a contact and separation mechanism causing the transferring roller 14 to contact or separate from the roller 62 via the intermediate transferring belt 15. The motor 33 generates driving force for driving to rotate the transferring roller 14 at the peripheral speed Vc (Vc≥Vb). The torque limiter 42 provided in the driving mechanism between the motor 33 and the transferring roller 14 transmits the driving force of the motor 33 in a range of the limited load torque to the transferring roller 14.

With this structure, in <State A> where the sheet S is carried only by the driven roller 11 and the driving roller 12, the driving roller 12 receives the driving force of the motor 31 thereby rotating at a peripheral speed Va. Thus, a paper P (sheet S) interposed between the driving roller 12 and the driven roller 11 is carried by the driving roller 12 and the driven roller 11 at the speed Va.

In <State B> where the sheet S is carried by the driven roller 11 and the driving roller 12 and also by the intermediate transferring belt 15 and the transferring roller 14, the intermediate transferring belt 15 rotates at the peripheral speed Vb. Here, when the transferring roller 14 contacts the roller 62 via the intermediate transferring belt 15, the load torque of the torque limiter 42 may exceed a limit torque. In this case, the torque limiter 42 cuts off the driving force of the motor 33 being applied to the transferring roller 14. Then, the transferring roller 14 is driven by the intermediate transferring belt 15 to rotate at the peripheral speed Vb. Further, because the sheet S is carried at the speed Vb faster than the peripheral speed Va of the driving roller 12, the one-way clutch 41 idles to cut off the driving force from the motor 31. Thus, the driving roller 12 is driven by the sheet S to rotate at the peripheral speed Vb. As described, in <State B>, the intermediate transferring belt 15, the transferring roller 14, and the driving roller 12 rotate at the peripheral speed Vb to thereby carry the sheet S at the speed Vb.

In <State C> where the sheet S is carried only by the intermediate transferring belt 15 and the transferring roller 14, the intermediate transferring belt 15 and the transferring roller 14 continuously rotate at the peripheral speed Vb to thereby carry the sheet S at the speed Vb.

As described, between <State B> and <State C>, wherein the toner image formed on the intermediate carrying belt 15 is transferred to the sheet S, the sheet S is carried at the constant speed Vb in the sheet carrying device 100. Therefore, the image forming apparatus 102 can prevent an abnormal image such as banding, which is caused by variation of the carrying speed of the sheet S in transferring the toner, from occurring to thereby enable forming an even image.

Meanwhile, it is possible to use the torque limiter 43 of the second embodiment instead of the one-way clutch 41 of the first carrying unit 1 so that the driving roller 12 is driven to rotate by the sheet S in <State B>. Thus, it is possible to maintain the sheet carrying speed to be constant between <State B> and <State C>.

Fourth Embodiment

Next, a fourth embodiment is described with reference to figures. Where the same reference symbols are attached to the same parts, repeated description of the parts may be omitted.

Figure 5:
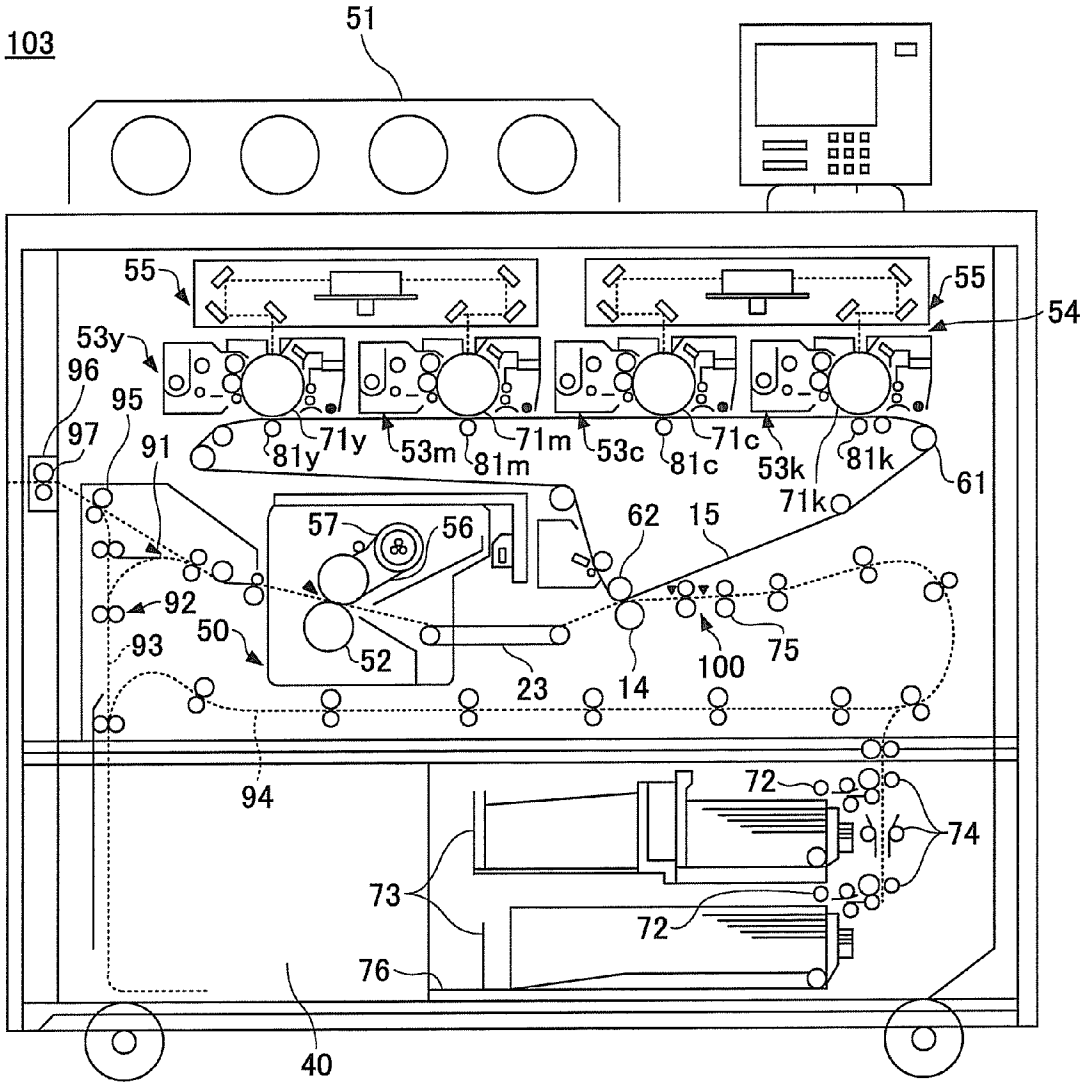
FIG. 5 illustrates a schematic structure of an image forming apparatus of a fourth embodiment.

FIG. 5 illustrates a schematic structure of an image forming apparatus 103 of the fourth embodiment.

The image forming apparatus 103 has an intermediate transferring belt 15 in an endless shape in a center of the image forming apparatus 103. The intermediate transferring belt 15 can rotate to carry an image in a clockwise direction on FIG. 5 by bridging plural rollers. Plural image forming units 53 are arranged along the carrying direction of the intermediate transferring belt 15 and over the intermediate transferring belt 15. The plural image forming units 53 are arranged laterally to form a tandem image forming apparatus 54. Exposure devices 55 are arranged over the tandem image forming apparatus 54.

The image forming units 53 of the tandem image forming apparatus 54 have photoreceptor drums 71 as image holders for various color toner images.

At primary transferring positions where the toner images are transferred from the photoreceptor drums 71 to the intermediate transferring belt 15, primary transferring rollers 81 are provided. The primary transferring rollers 81 are components of the primary transferring unit. The primary transferring rollers 81 face the photoreceptor drums 71 via the intermediate transferring belt 15 interposed between the primary transferring rollers 81 and the photoreceptor drums 71. A roller 61 is a driving roller for driving to rotate the intermediate transferring belt 15.

A secondary transferring device is provided on a side (a downstream side of the intermediate transferring belt 15 in the carrying direction) opposite to the tandem image forming apparatus 54 relative to the intermediate transferring belt 15. The secondary transferring device transfers the image on the intermediate transferring belt 15 to the sheet S by applying a transferring electric field while pressing a transferring roller 14 onto a roller 62 as a secondary transferring opposite roller. In the secondary transferring device, a transferring electric current for the transferring roller 14, which is a parameter of a transferring condition, is changed depending on the sheet S.

The image forming apparatus 103 includes a sheet carrying device 100 having the same structure as that of the third embodiment to maintain the carrying speed of the sheet S in transferring the toner image to the sheet S constant. Further, the sheet carrying device 100 of the fourth embodiment measures the carrying distance and the length in the carrying direction of the sheet S carried by a structure and a method described below.

A fixing unit 50 includes a halogen lamp 57 as a heat source, a fixing belt 56 being an endless belt, and a pressure roller 52. In the fixing unit 50, the pressure roller 52 presses the fixing belt 56. In the fixing unit 50, parameters of a fixing condition are changed depending on the sheet S. The parameters of the fixing condition may be temperatures of the fixing belt 56 and the pressure roller 52, a nip width between the fixing belt 56 and the pressure roller 52, and the rotational speed of the pressure roller 52. The carrying belt 23 carries the sheet S after transferring the image on the sheet from the secondary transferring device to the fixing unit 50.

When the image data are sent to the image forming apparatus 103 and a signal for starting to form the image is received by the image forming apparatus 103, a driving motor (not illustrated) drives to rotate the roller 61 thereby driving to rotate other plural rollers. Thus, the intermediate transferring belt 15 is carried to rotate.

Simultaneously, one-color images are formed in the photoreceptor drums 71 in the image forming units 53, respectively. When the intermediate transferring belt 15 is carried, the one-color images are sequentially transferred to form a composite color image on the intermediate transferring belt 15.

Further, one of paper feeding rollers 72 on a paper feeding table 76 is selectively rotated in order to feed the sheet S from one of paper feeding cassettes 73. The fed sheet S is carried by carrying rollers 74 until the fed sheet S is stopped after striking a registration roller 75. The registration roller 75 is rotated on the timing of arrival of the composite color image on the intermediate transferring belt 15. Thus, the composite color image is transferred to the sheet S in the secondary transferring device. The sheet S after the transfer of the image is carried by the secondary transferring device so as to be brought into the fixing unit 50. After fusing and depositing the transferred image by applying heat and pressure, in duplex printing, the sheet S is carried to a sheet reversing path 93 by a branching claw 91 and a flip roller 92. Thereafter, the sheet S is switched back by a branching claw, paired rollers, or the like to carry the sheet S into a duplex carrying path 94 after switching back the sheet S. Then, as described above, the composite color image is recorded on the back surface of the sheet S.

When the sheet is reversed and ejected, the sheet S is carried into the sheet reversing path 93 by the branching claw 91, and the sheet S is carried on the side of an ejecting roller 95 by the flip roller 92. Thus, the front and back sides of the sheet S are reversed and the sheet is ejected.

In single-side printing or without reversing the sheet, the sheet S is carried to the ejecting roller 95 by the branching claw 91.

Thereafter, the sheet S is carried to a decurl unit 96 by the ejecting roller 95. In the decurl unit 96, the decurl amount is changed depending on the sheet S. The decurl amount is adjusted by changing the pressure of a decurl roller 97. The sheet S is ejected by the decurl roller 97. A purge tray 40 is arranged below the reverse ejecting unit.

As a registration mechanism for correcting the position of the sheet S in the carrying direction and the position in the width direction perpendicular to the carrying direction, instead of the registration roller 75, a registration gate and a skew correcting mechanism may be provided. In this case, the sheet carrying device 100 controls a carrying timing of the sheet S into the secondary transferring portion between the roller 62 and the transferring roller 14. Specifically, the sheet carrying device 100 controls the carrying speed of the sheet S based on a detection result obtained by a sheet detecting sensor which is provided between the registration mechanism and the sheet carrying device 100 so that the timing when the toner image on the intermediate transferring belt 15 reaches the secondary transferring portion matches the timing when the sheet S reaches the secondary transferring portion.

<Structure of Sheet Carrying Device>

Figure 6:
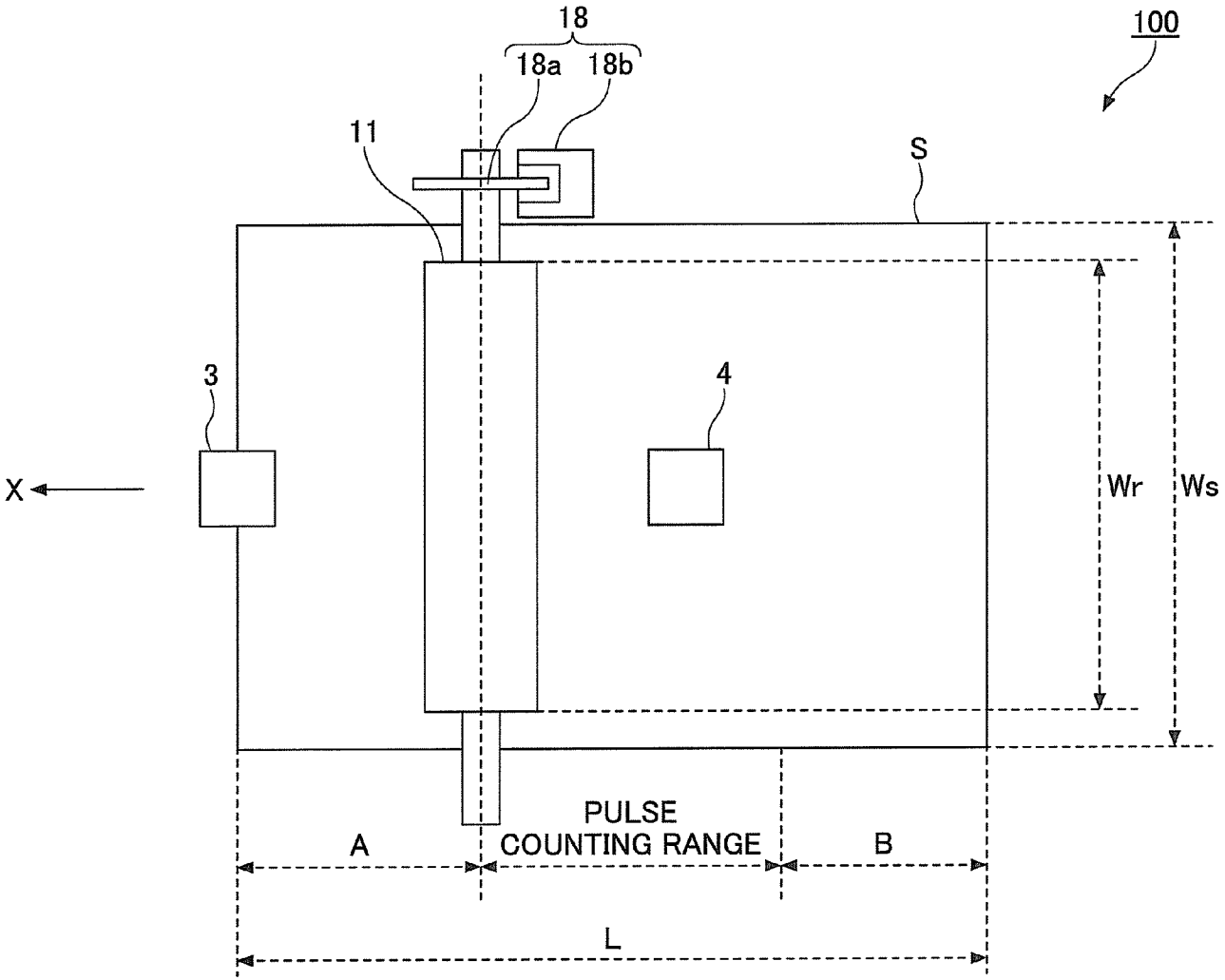
FIG. 6 is a plan view schematically illustrating a sheet carrying device of the fourth embodiment.
Figure 7:
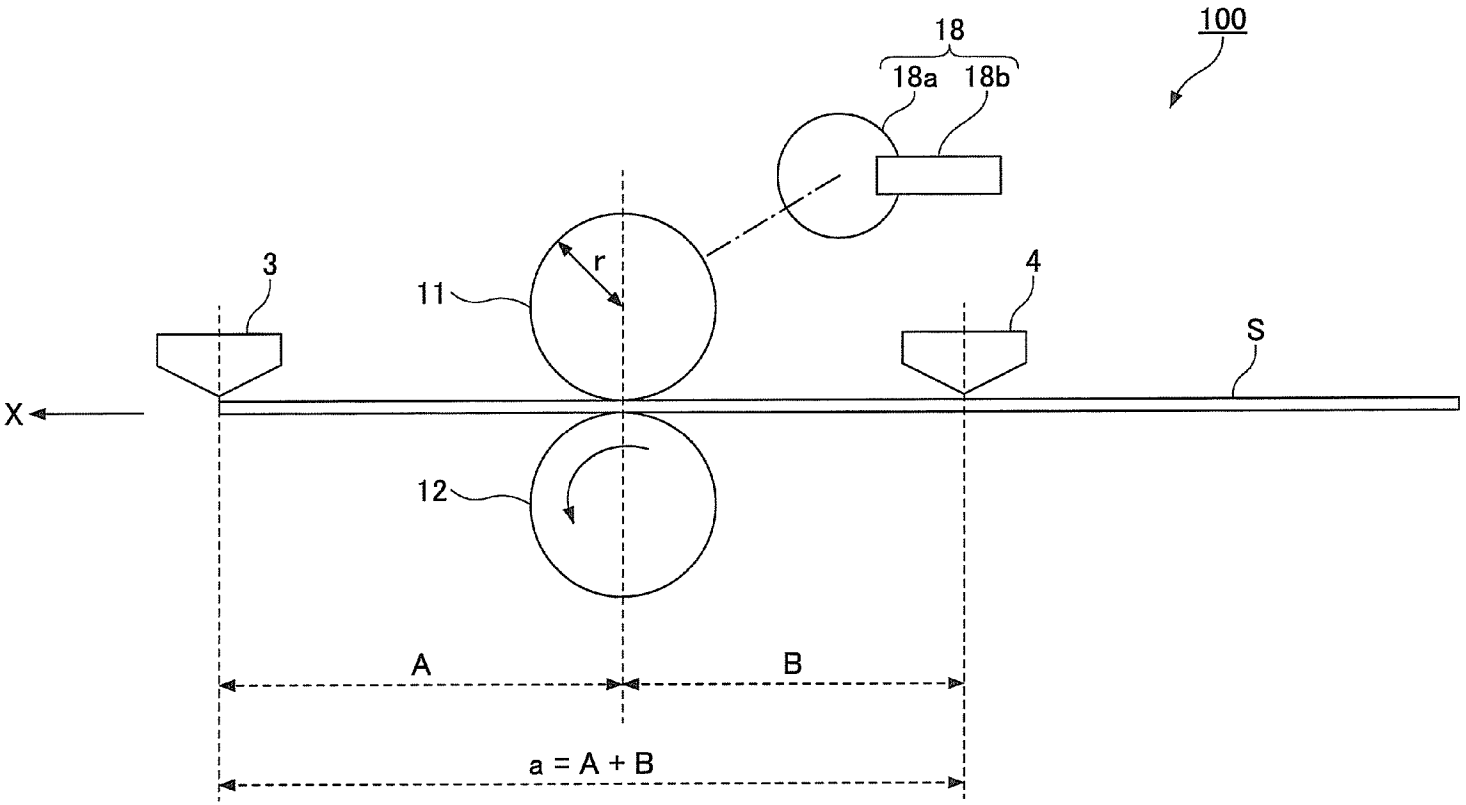
FIG. 7 is a cross-sectional view schematically illustrating the sheet carrying device of the fourth embodiment.

The schematic structure of the sheet carrying device 100 of the fourth embodiment is illustrated in FIGS. 6 and 7. FIG. 6 is a plan view schematically illustrating the sheet carrying device 100. FIG. 7 is a cross-sectional view schematically illustrating the sheet carrying device 100.

The sheet carrying device 100 includes a driving roller 12 driven to rotate by a driving unit such as a motor (not illustrated) and a driven roller 11 driven to rotate while the sheet S is interposed between the driving roller 12 and the driven roller 11. On the downstream side of a sheet carrying direction relative to the driven roller 11 and the driving roller 12, a transferring roller 14 and a roller 62 facing the transferring roller 14 via an intermediate transferring belt 15 are provided. A one-way clutch or a torque limiter is provided in a driving mechanism between the driving roller 12 and the driving unit of the driving roller 12. Further, a torque limiter is provided in a driving mechanism between the transferring roller 14 and a driving unit of the transferring roller 14. With this structure of the sheet carrying device 100 of the fourth embodiment, in a manner similar to the third embodiment, the carrying speed of the sheet S can be maintained to be constant.

Referring to FIG. 6, the width Wr of the driven roller 11 in a direction perpendicular to the carrying direction of the sheet S is made smaller than the minimum width Ws of the sheet S which can be carried by the sheet carrying device 100. Therefore, because the driven roller 11 does not contact the driving roller 12 when the sheet S is carried, the driven roller 11 is driven only by friction caused between the sheet and the driven roller 11. Therefore, the driven roller 11 is not affected by the driving roller 12 while the sheet S is carried to thereby enable more accurate measurement of the carrying distance of the sheet S using a method described below.

Referring to FIGS. 6 and 7, a rotary encoder 18 is provided on the rotational shaft of the driven roller 11 of the sheet carrying device 100. A pulse counting unit (not illustrated) is a carrying amount measuring unit for measuring the sheet carrying amount of the sheet S. The pulse counting unit counts pulse signals generated between a rotating encoder disk 18*a* and an encoder sensor 18*b*. Thus, the rotation amount of the driven roller 11 is measured as the carrying amount of the sheet.

Within the fourth embodiment, the rotary encoder 18 is provided on the rotary shaft of the driven rollers 11, and the rotary encoder 18 may be provided in the rotary shaft of the driving roller 12. The number of rotations in carrying the sheet S increases as the diameter of a roller, to which the rotary encoder is attached, is smaller. When the number of rotations in carrying the sheet S increases, the number of pulses to be counted increases to thereby enable a highly accurate measurement of the carrying distance of the sheet S.

It is preferable that the driven roller 11 or the driving roller 12, to which the rotary encoder 18 is attached, be made of a metallic roller to ensure an axis centering accuracy. By suppressing decentering of the rotary shaft, it is possible to highly accurately measure the carrying distance of the sheet S to be described below.

Sensors 3 and 4 are provided in a vicinity of an upstream side and a vicinity of a downstream side in the carrying direction of the sheet S relative to the driven roller 11 and the driving roller 12, respectively. The sensors 3 and 4 can detect a passage of the edge of the carried sheet S. For example, each of the sensors 3 and 4 may be a transmission type optical sensor or a reflection type optical sensor. Within the fourth embodiment, the reflection type optical sensor is used.

The sensor 3 is provided on the downstream side of the sheet S in the carrying direction relative to the driven roller 11 and the driving roller 12. The sensor 3 is a start trigger sensor 3 as a downstream detecting unit for detecting an arrival of the leading edge of the sheet S. The sensor 4 is provided on the upstream side of the sheet S in the carrying direction relative to the driven roller 11 and the driving roller 12. The sensor 4 is a stop trigger sensor 4 as a upstream detecting unit for detecting an arrival of the trailing edge of the sheet S.

Positions of the widths of the start trigger sensor 3 in the directions perpendicular to the carrying direction of the sheet S are substantially the same as positions of the widths of the stop trigger sensor 4 in the directions perpendicular to the carrying direction of the sheet S. By providing as such, an influence of the posture (a skew relative to the carrying direction) of the sheet S is minimized thereby enabling measurement of the carrying distance of the sheet S more accurately.

Within the fourth embodiment, the two sensors 3 and 4 are arranged in a center position in the width directions perpendicular to the carrying direction of the sheet S. As long as they are in the area where the sheet S passes, the positions of the sensors 3 and 4 can be shifted in the width directions.

The distance A illustrated in FIG. 6 is between the start trigger sensor 3 and the driven roller 11 (and the driving roller 12). The distance B illustrated in FIG. 6 is between the stop trigger sensor 4 and the driven roller 11 (and the driving roller 12). It is preferable that the distances A and B are made as short as possible because a pulse counting range (to be described later) can be wider.

The driving roller 12 rotates in the arrow direction in FIG. 7. The driven roller 11 is driven by the driving roller 12 while the sheet S is not carried (during idling). The driven roller 11 is driven by the sheet S while the sheet S is carried. When the driven roller 11 rotates, a pulse is generated from the rotary encoder 18 provided in the rotary shaft.

The pulse counting unit connected to the rotary encoder 18 starts counting pulses of the rotary encoder 18 when the start trigger sensor 3 detects that the leading edge of the sheet S carried in the arrow direction X passes by the start trigger sensor 3. The pulse counting unit stops counting pulses of the rotary encoder 18 when the stop trigger sensor 4 detects that the trailing edge of the sheet S carried in the arrow direction X passes by the stop trigger sensor 4.

Figure 8:
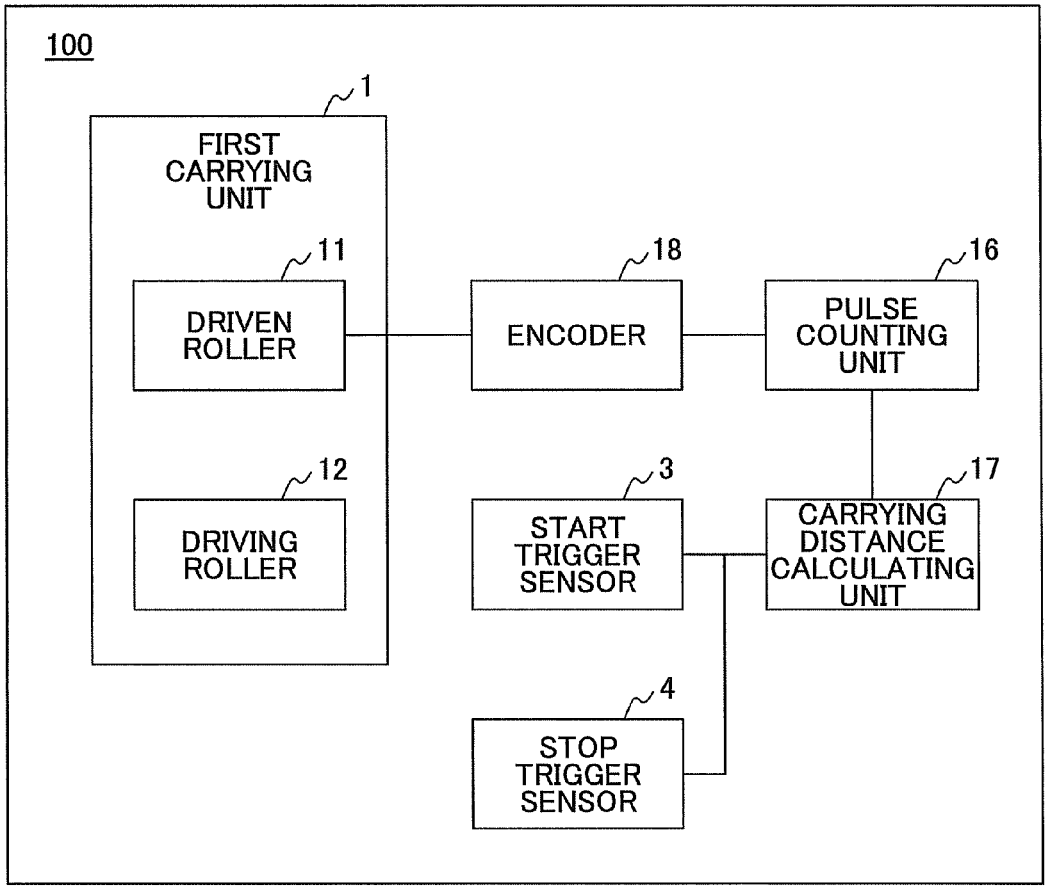
FIG. 8 is a block chart illustrating a functional structure of an image forming apparatus of the fourth embodiment.

FIG. 8 is a block chart exemplifying a function structure of the sheet carrying device 100 of the fourth embodiment.

Referring to FIG. 8, the sheet carrying device 100 includes the first carrying unit 1 including the driven roller 11 and the drive roller 12, the encoder 18, the start trigger sensor 3, the stop trigger sensor 4, a pulse counting unit 16, and a carrying distance calculating unit 17.

As described, the pulse counting unit 16 counts the pulse signals generated by the encoder sensor 18*b* by rotating the encoder disk 18*a* of the rotary encoder 18 which is provided on the driven roller 11 as described above. The rotation amount of the driven roller 11 is measured as the carrying amount of the sheet S.

The carrying distance calculating unit 17 calculates the carrying distance of the sheet S by the sheet carrying unit 1 based on a detection result of the sheet S by the start trigger sensor 3 and the stop trigger sensor 4 and the rotation amount of the driven roller 11 measured by the pulse counting unit 16.

<Sheet Carrying Distance Calculating Method>

Next, the carrying distance calculating method of the sheet S in the sheet carrying device 100 is described.

Figure 9:
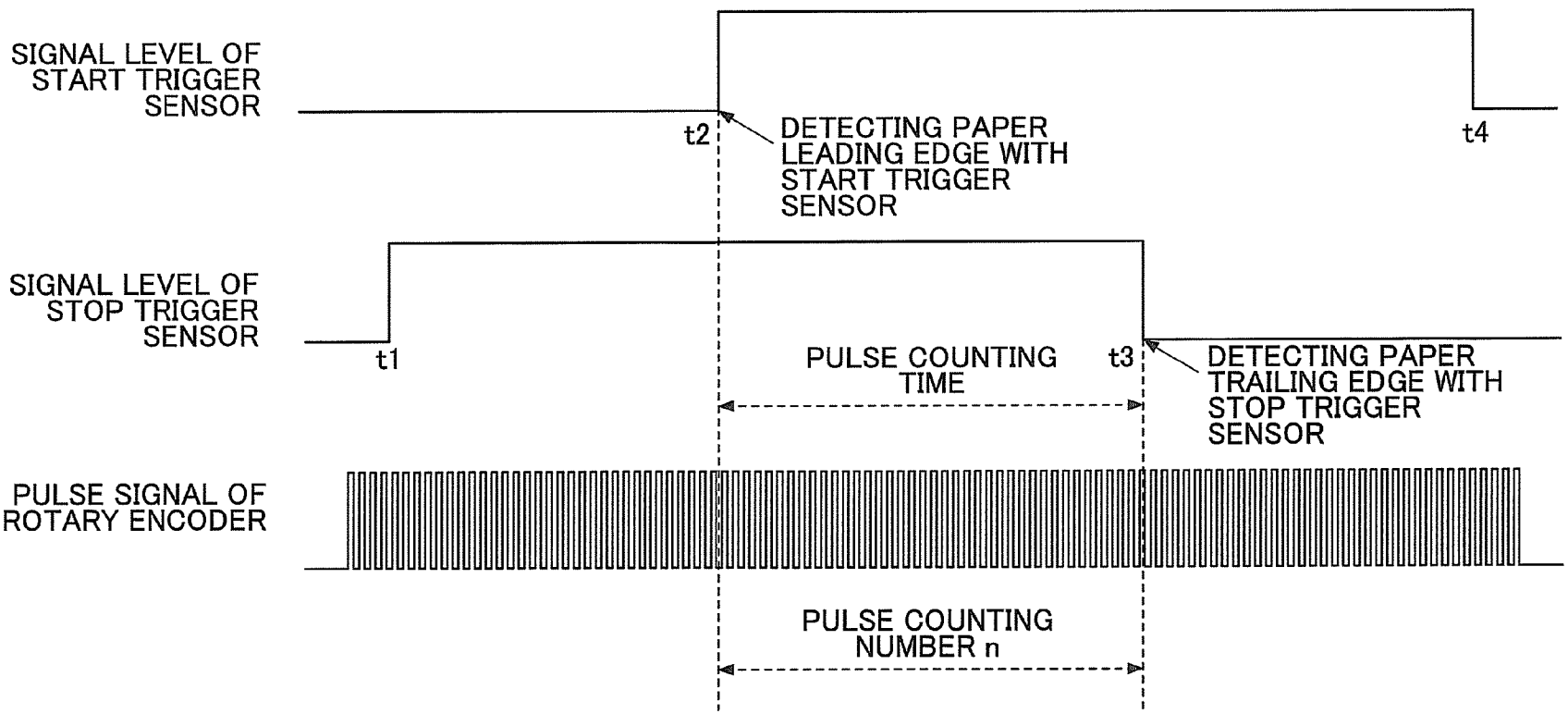
FIG. 9 illustrates exemplary outputs from a start trigger sensor, a stop trigger sensor, and an encoder of the fourth embodiment.
Figure 10:
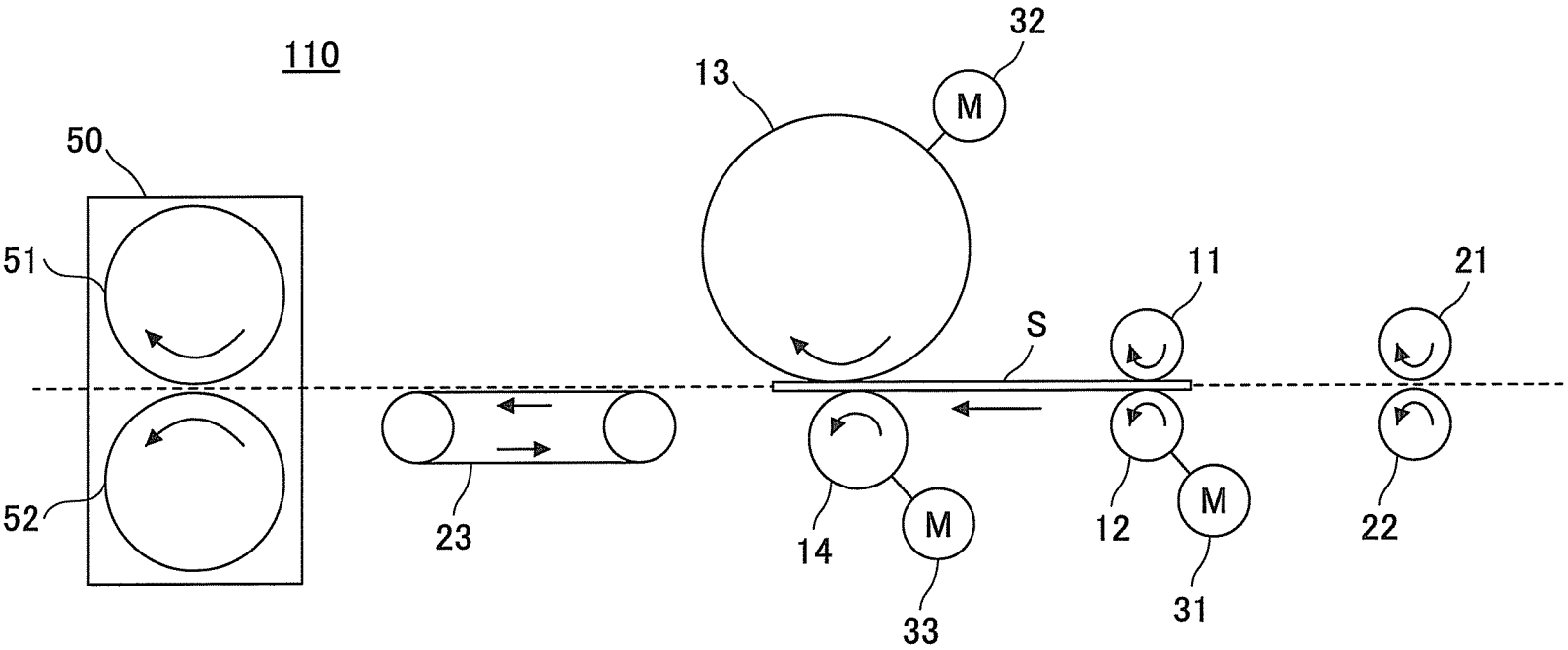
FIG.10 RELATED ART
FIG. 10 illustrates a schematic structure of an image forming apparatus of the related art.

FIG. 9 illustrates exemplary outputs from the start trigger sensor 3, the stop trigger sensor 4, and the rotary encoder 18.

As described, when the driven roller 11 is rotated, a pulse signal is generated from the rotary encoder 18 provided on the rotary shaft of the driven roller 11.

After the stop trigger sensor 4 detects passage of the leading edge of the carried sheet S at a time t1, the start trigger sensor 3 detects that the leading edge of the sheet S passes by the start trigger sensor 3 at a time t2.

After the stop trigger sensor 4 detects passage of the trailing edge of the carried sheet S at a time t3, the start trigger sensor 3 detects that the trailing edge of the sheet S passes by the start trigger sensor 3 at a time t4.

During a time interval between the time t2 when the start trigger sensor 3 detects the passage of the leading edge of the sheet S and the time t3 when the stop trigger sensor 4 detects the passage of the trailing edge of the sheet S, the pulse counting unit 16 counts the pulses of the rotary encoder 18.

The radius of the driven roller 11 on which the rotary encoder 18 is provided is designated by r. The number of encoder pulses corresponding to a circumference of the driven roller 11 is designated by N. The number of pulses counted during the pulse counting time is designated by n. At this time, the carrying distance L of the sheet S between the time t2 and the time t3 is obtained by the following formula 1.

$$L=(n/N)\times 2\pi r; \qquad \text{Formula 1}$$

where n designates the counted number of pulses, N designates the number of pulses corresponding to the circumference of the driven roller 11 [/r], and r designates the radius of the driven roller 11.

Generally, the sheet carrying speed varies depending on the accuracy in an outer shape of a roller (especially, the driving roller 12) carrying the sheet S, mechanical accuracy such as an axis centering accuracy, rotational accuracy of the motor or the like, and the accuracy of a power train mechanism such as a gear, a belt or the like. The pulse period and the pulse width of the rotary encoder 18 constantly vary because of slippage between the driving roller 12 and the sheet S, slack caused by sheet carrying force or the sheet carrying speed of the carrying units on the upstream and downstream sides, or the like. However, the pulse number does not change.

Therefore, the carrying distance calculating unit 17, provided in the sheet carrying device 100, can acquire the carrying distance L of the sheet S carried by the driven roller 11 and the driving roller 12, as the sheet carrying unit, without depending on the sheet carrying speed by the formula 1.

Further, the carrying distance calculating unit 17 can acquire relative ratios such as a ratio between pages of the sheet S or a front and back ratio.

For example, the carrying distance calculating unit 17 can acquire an extension ratio R from the following formula 2 from a relative ratio of the sheet carrying distance before and after thermal fixing by an electrophotographic method.

$$R=[(n2/N)\times 2\pi r]/[(n1/N)\times 2\pi r],$$

where n1 designates the number of pulses counted at a time of carrying the sheet S before heat fixing, and n2 designates the number of pulses counted at a time of carrying the sheet S after heat fixing.

Here, the example calculated in the fourth embodiment is descried as follows.

Within the fourth embodiment, when N=2800 [/r], r=9 [mm], and the pulse numbers counted at a time of longitudinally carrying the sheet of A3 size is n1=18816, the carrying distance L1 of the sheet S is as follows:

$$L1=(18816/2800)\times 2\pi\times 9=380.00\ [\mathrm{mm}]$$

When the pulse number counted again after heat fixing the sheet S is n2=18759, the carrying distance of the sheet S is as follows:

$$L2=(18759/2800)\times 2\pi\times 9=378.86\ [\mathrm{mm}]$$

Therefore, a front and back difference of the carrying distance of the sheet S is:

$$\Delta L=380.00-378.86=1.14\ [\mathrm{mm}]$$

From the calculation results of the front and back carrying distances of the sheet S, a ratio R of expansion and contraction of the sheet S (a relative ratio of the lengths of the front and back of the sheet S) is acquired as follows:

$$R=378.86/380.00=99.70[\%].$$

Therefore, since the length of the sheet S in the carrying direction contracts by about 1 mm, if the image lengths of the front and back of the sheet S are the same, there may occur a front and back register gap of about 1 mm. Therefore, by correcting the image lengths to be printed on the back surface of the sheet S, it becomes possible to enhance the front and back registering accuracy.

Within the above example, the carrying distances L1, L2 of the sheet S are calculated before and after the heat fixing to acquire the ratio R of expansion and contraction. For example, a calculation unit for calculating the ratio R of expansion and contraction may be provided to acquire a ratio between the numbers of pulses n1 and n2 counted at a time of carrying the sheet S before and after the heat fixing.

In the above example, when the pulse number counted at the time of carrying the sheet after the heat fixing is n2=18759, the ratio R of expansion and contraction can be acquired as follows:

$$R=n2/n1=18759/18816=99.70[\%]$$

By adding the distance a between the start trigger sensor 3 and the stop trigger sensor 4 illustrated in FIG. 7 to the sheet carrying distance L, the length L of the sheet S in the carrying direction is obtainable.

$$L=(n/N)\times 2\pi r+a,$$

where a designates the distance between the start trigger sensor 3 and the stop trigger sensor 4.

As described, the carrying distance calculating unit 17 of the sheet carrying device 100 can acquire the length of the sheet S in the sheet carrying direction by the formula 3 obtained by adding the distance a to the carrying distance L of the sheet S carried by the sheet carrying unit acquired by the formula 1.

Further, the carrying distance calculating unit 17 acquires the ratio R of expansion and contraction by following formula 4 from a relative ratio of the lengths L of the sheet S in the carrying direction before and after the heat fixing in the electrophotographic method.

$$R=[(n2/N)\times 2\pi r+a]/[(n1/N)\times 2\pi r+a],$$

where the carrying distance calculating unit 17 of the sheet carrying device 100 acquires the lengths L of the sheet S in the sheet carrying direction highly accurately to calculate the ratio R of expansion and contraction.

<Image Magnifying Correction Based on Calculation Result of Sheet Carrying Distance>

The sheet carrying device 100 calculates the carrying distance or the length of the sheet S in the carrying direction by the above described method. The length in the width direction perpendicular to the carrying direction of the sheet S, namely the width of the sheet S, can be acquired by measuring both ends in the width direction of the sheet S with a contact image sensor (CIS).

After the sheet S undergoes a measurement of a sheet size such as the carrying distance, the length in the carrying direction, or the sheet width, a toner image is transferred to the sheet S between the transferring roller 14 and the intermediate transferring belt 15. The toner image is fixed to the sheet S to which the toner image is transferred after the sheet S is carried to the fixing unit 50. The sheet S may contract by being heated at a time of passing through the fixing unit 50.

Thereafter, in a state where the sheet S is reversed by the sheet reversing path 93, the sheet S is carried to the sheet carrying device 100 so as to be measured. Thereafter, the toner image is transferred and fixed to the back surface of the sheet S.

The screen size and the image position of the toner image in the subsequent sheet S is corrected based on the measured front and back sheet size ratio. This correction is referred to as an image magnifying correction. As a result, the image sizes printed on the front and back of the sheet S match to thereby improve a front and back registering accuracy.

The contraction of the sheet S after the above fixing changes so as to be recovered in a passage of time. Therefore, it is advantageous to acquire a front and back ratio of the sheet length more accurately by measuring the sheet carrying distance or the length of the sheet in the sheet carrying direction in order to enhance the front and back registering accuracy.

Next, a process of the image magnifying correction based on the sheet size measured by the sheet carrying device 100 is described. Within the fourth embodiment, the sheet length is measured immediately before reaching the transferring roller 14 in the sheet carrying device 100 (an immediate upstream side in the sheet carrying direction). Therefore, the measured sheet size is reflected on an exposure data size or an exposure timing not for the measured sheet S but for the subsequent sheet.

The exposure device 55 includes a data buffer unit (not illustrated) that comprises a memory or the like to buffer input image data, an image data generating unit that generates image data for forming an image, an image magnifying correction unit for performing an image magnifying correction in the sheet carrying direction from sheet size information, a clock generating unit that generates a write clock, and a light emitting device that forms an image by irradiating light on the photoreceptor drum 71.

The data buffer unit buffers the input image data sent from a host apparatus (not illustrated) such as a controller by a transfer clock.

The image data generating unit generates the image data based on the write clock from the clock generating unit and pixel insertion and extraction information obtained from the image magnifying correction unit. The drive data output from the image data generating unit controls ON/OFF of the light emitting device using the time interval corresponding to one period of the write clock as one pixel for forming the image.

The image magnifying correction unit generates an image magnification switching signal for switching the image magnification from the sheet size information measured by the sheet carrying device 100.

The clock generating unit is operated at a high frequency so that a clock cycle can be changed. Further, in order to perform an image correction with such as a pulse width modulation, the clock generating unit is operated at a high frequency several times faster than that of the write clock. The clock generating unit generates the write clock at a frequency corresponding to the processing speed of the apparatus.

The light emitting device is structured by any one or a group of a semiconductor laser, a semiconductor laser array, a surface-emitting laser, or the like. Light is irradiated onto the photoreceptor drum 71 depending on drive data to form an electrostatic latent image.

A pre-fixture image made of a toner image formed on the sheet S is heated and pressurized inside the fixing unit 50 so as to be fixed on the sheet S. The sheet S may be deformed by heat and pressure to thereby change the length of the sheet S in the carrying direction by expansion and contraction. As a result, there may occur a difference between an image forming position on the back surface of the sheet S and an image forming position on the front surface of the sheet S. Thus, the picture quality of the output image and the front and back registering accuracy (shift between images on front and back surfaces by deformation of the surfaces) are influenced. The fixing unit 50 may be a type of fixing using heating and pressurizing as in the fourth embodiment. Alternatively, the fixing unit 50 may be a type of separately heating and pressurizing, flash fixing, or the like.

Therefore, by correcting the image magnification depending on the measured sheet size and changing a start position of printing, an image can be formed to cancel the deformation of the sheet S. Although the sheet S resultantly deforms, it is possible to print an image having high front and back registering accuracy.

The sheet size including the deformation of sheet S can be acquired from the sheet carrying device 100. Further, depending on the deformation of the sheet S, it is possible to perform a correction of only expansion, a correction of only contraction, and a correction of expansion and contraction.

During duplex printing, when a toner image is fixed on the front surface of the sheet S by positioning one end of the sheet S forward, the sheet S deforms. Thereafter, the sheet S is reversed by the sheet reversing path 93 inside the image forming apparatus 103. At this time, the leading edge of the sheet S inserted into the fixing unit 50 is changed to the other end opposite to the leading edge in printing the front surface. At this time, if the image position is not corrected, the trailing edge of the fixed output image viewed from above (the back surface) shifts from the trailing edge of the fixed image on the front surface which is previously formed. Therefore, the front and back registering accuracy is degraded.

On the contrary, by correcting the image magnification and the correction of the image forming position at the time of forming the image on the back surface of the sheet, the front and back registering accuracy is enhanced.

<General Overview>

As described above, within the first to fourth embodiments, it is possible to maintain the carrying speed of the paper P constant in the sheet carrying device. In the image forming apparatus having the sheet carrying device, it is possible to prevent an abnormal image such as banding from occurring to thereby output an even high quality image. Further, by providing the sensors for detecting the edges of the carried sheets, the carrying distance of the carried sheet and the length of the sheet in the carrying direction are calculated depending on the detection results of the sensor, the rotation amount of the carrying roller, or the like. Based on the results of the calculation, the image magnifying correction may be performed to improve the front and back registering accuracy.

The embodiments of the present invention are not limited to the first to fourth embodiments. It is possible to structure as follows.

For example, the first carrying unit may be formed by a driving roller and a driven roller in a manner similar to the above embodiments, and the second carrying unit may be formed by paired driving rollers driven to rotate, a one-way clutch or a torque limiter may be provided to a driving mechanism between the driving roller and the motor of the first carrying unit 1, and a torque limiter is provided to a driving mechanism between one of the driving rollers and the motor of the second carrying unit 2. In this sheet carrying device, by setting the outputs of the motors and the peripheral speeds of the driving rollers, it is possible to carry the sheet S between the first carrying unit 1 and the second carrying unit 2 at a constant speed.

Further, it is possible to provide an image forming apparatus including the above described sheet carrying device, which has an image forming unit for printing an image on the surface of the sheet S with ink or the like between the first carrying unit 1 and the second carrying unit 2. With this image forming apparatus, because the sheet carrying speed while the image is being printed can be maintained constant it is possible to form an even high quality image on the surface of the sheet S.

Further, it is possible to provide an image inspection apparatus including the above sheet carrying device and an image reading unit between the first carrying unit and the second carrying unit, wherein an image or the like on a carried sheet is read to administrate the quality of the image. With this image inspection apparatus, because the sheet carrying speed is maintained constant between the first carrying unit 1 and the second carrying unit 2, the image or the like on the sheet can be highly accurately read.

Further, it is possible to provide a sheet length measuring apparatus including the above sheet carrying device and a detecting unit positioned between the first carrying unit 1 and the second carrying unit 2 for detecting sheet edges, wherein the sheet carrying distance and the length of a sheet in the sheet carrying direction are detected based on a time period between a detection of passage of the leading edge and a detection of the trailing edge and the sheet carrying speed by the first carrying unit 1 and the second carrying unit 2. With the sheet length measuring apparatus, because the sheet carrying speed is maintained constant between the first carrying unit and the second carrying unit, it is possible to acquire the length of the sheet carrying direction highly accurately based on the detection time interval between the leading edge and the trailing edge.

Within the embodiments, there is provided a sheet carrying device, with which the sheet carrying speed is stabilized.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the sheet carrying device has been described in detail, it should be understood that various changes, substitutions, and alterations could be made thereto without departing from the spirit and scope of the invention.

This patent application is based on Japanese Priority Patent Application No. 2012-047793 filed on Mar. 5, 2012 and Japanese Priority Patent Application No. 2012-161381 filed on Jul. 20, 2012, the entire contents of which are hereby incorporated herein by reference.

What is claimed is:

1. A sheet carrying device which carries a sheet, the sheet carrying device comprising:

a first carrying unit; and a second carrying unit, wherein the sheet is transferred from the first carrying unit to the second carrying unit, wherein the first carrying unit includes a first rotary body, a first driving unit that outputs a driving force for driving to rotate the first rotary body at a first peripheral speed, a one-way clutch that transmits the driving force output by the first driving unit to the first rotary body only in a direction in which the first rotary body carries the sheet, a second rotary body that is driven to rotate by the first rotary body via the sheet while the sheet is interposed between the first rotary body and the second rotary body, wherein the second carrying unit includes a third rotary body that rotates at a second peripheral speed equal to or faster than the first peripheral speed, a fourth rotary body that carries the sheet while the sheet is interposed between the third rotary body and the fourth rotary body, a second driving unit that outputs a driving force for driving to rotate the fourth rotary body at a third peripheral speed equal to or faster than the second peripheral speed, and a torque limiter that has a slip torque smaller than a torque for carrying the sheet while the sheet is interposed between the third rotary body and the fourth rotary body and cuts off the driving force output by the second driving unit while the sheet is interposed between the third rotary body and the fourth rotary body so as to be carried.

2. The sheet carrying device according to claim 1, wherein the first, second, and third peripheral speeds are designated by Va, Vb, and Vc, respectively, and the first, second, and third peripheral speeds satisfy a relationship of $$0.90Vb \leq Va \leq 0.99Vb, \text{ and}$$

$$1.001Vb \leq Vc \leq 1.05Vb.$$

3. The sheet carrying device according to claim 1, wherein the third rotary body is an endless belt bridged by a plurality of rollers including a roller facing the fourth rotary body, and at least one of the plurality of rollers is driven to rotate.

4. The sheet carrying device according to claim 1, the sheet carrying device further comprising:

an upstream detecting unit that is provided on an upstream side of the first carrying unit and detects the sheet;

an downstream detecting unit that is provided between the first carrying unit and the second carrying unit and detects the sheet;

a carrying amount measuring unit that measures a carrying amount of the sheet by the first rotary body; and a carrying distance calculating unit that calculates a carrying distance of the sheet based on a measurement result measured by the carrying amount measuring unit and detection results detected by the upstream detecting unit and the downstream detecting unit.

5. The sheet carrying device according to claim 1, the sheet carrying device further comprising:

a detecting unit that is provided between the first carrying unit and the second carrying unit and detects the sheet; and a carrying distance calculating unit that calculates a carrying distance of the sheet based on a time interval between a detection of a leading edge of the sheet and a trailing edge of the sheet and a carrying speed of the sheet by the first carrying unit and the second carrying unit.

6. The sheet carrying device according to claim 1, wherein the third rotary body is an image holder.

7. A sheet carrying device which carries a sheet, the sheet carrying device comprising:

a first carrying unit; and a second carrying unit, wherein the sheet is transferred from the first carrying unit to the second carrying unit, wherein the first carrying unit includes a first rotary body, a first driving unit that outputs a driving force for driving to rotate the first rotary body at a first peripheral speed, a one-way clutch that transmits the driving force output by the first driving unit to the first rotary body only in a direction in which the first rotary body carries the sheet, a second rotary body that is driven to rotate by the first rotary body via the sheet while the sheet is interposed between the first rotary body and the second rotary body, wherein the second carrying unit includes a third rotary body that rotates at a second peripheral speed equal to or faster than the first peripheral speed, a second driving unit that outputs a driving force for driving to rotate the third rotary body at the second peripheral speed equal to or faster than the first peripheral speed, a fourth rotary body that carries the sheet while the sheet is interposed between the third rotary body and the fourth rotary body, a third driving unit that outputs a driving force for driving to rotate the fourth rotary body at a third peripheral speed equal to or faster than the second peripheral speed, and a torque limiter that has a slip torque smaller than a torque for carrying the sheet while the sheet is interposed between the third rotary body and the fourth rotary body and cuts off the driving force output by the third driving unit while the sheet is interposed between the third rotary body and the fourth rotary body so as to be carried.

* * * * *